US008209802B2

(12) United States Patent
Linares

(10) Patent No.: US 8,209,802 B2
(45) Date of Patent: Jul. 3, 2012

(54) COMBINATION MEDICAL SUPPORT TABLE AND PORTABLE CONVERTIBLE STRETCHER UNIT

(75) Inventor: Miguel A. Linares, Bloomfield Hills, MI (US)

(73) Assignee: Linares Medical Devices, LLC, Auburn Hills, MI (US), part interest ( * ) Notice: Subject to any disclaimer, the term of this patent is extended or adjusted under 35 U.S.C. 154(b) by 543 days.

(21) Appl. No.: 12/420,587

(22) Filed: Apr. 8, 2009

(65) Prior Publication Data

US 2010/0257673 A1 Oct. 14, 2010

(51) Int. Cl.
*A47B 1/00* (2006.01)

(52) U.S. Cl. ..... 5/625; 5/626; 5/627; 108/132; 108/129

(58) Field of Classification Search ..... 5/625–627, 5/114; 108/129, 132, 167
See application file for complete search history.

(56) References Cited

U.S. PATENT DOCUMENTS

| | | | | | |
|---|---|---|---|---|---|
| 894,353 | A * | 7/1908 | Clifton | 172/105 |
| 1,063,642 | A * | 6/1913 | Birdsall | 108/36 |
| 1,246,516 | A * | 11/1917 | Zeleznik | 5/625 |
| 2,387,376 | A * | 10/1945 | Winer et al. | 5/627 |
| 2,394,245 | A * | 2/1946 | Koller | 5/627 |
| 2,396,931 | A * | 3/1946 | Schmid | 5/627 |
| 2,640,996 | A * | 6/1953 | Davis | 5/8 |
| 2,652,300 | A * | 9/1953 | Graber et al. | 108/93 |
| 2,903,313 | A * | 9/1959 | Block | 108/35 |
| 3,167,789 | A | 2/1965 | Wicks | |
| 3,287,895 | A * | 11/1966 | Hire | 5/627 |
| 4,037,871 | A | 7/1977 | Bourgraf et al. | |
| 4,921,295 | A | 5/1990 | Stollenwerk | |
| 5,201,536 | A | 4/1993 | Bono et al. | |
| 5,345,881 | A | 9/1994 | Loescher | |
| 5,375,277 | A | 12/1994 | Carr et al. | |
| 5,687,978 | A | 11/1997 | Rhodes et al. | |
| 6,276,012 | B2 | 8/2001 | Borders | |
| 6,283,496 | B1 | 9/2001 | Dickmann | |
| 6,295,669 | B1 * | 10/2001 | Saus | 5/116 |
| 6,374,438 | B1 | 4/2002 | Fox et al. | |
| 6,966,081 | B1 | 11/2005 | Sharps et al. | |
| 7,044,496 | B2 | 5/2006 | Holmes | |
| 7,150,465 | B2 | 12/2006 | Darling, III | |
| 7,407,177 | B2 | 8/2008 | Darling, III | |
| 2006/0096509 | A1 * | 5/2006 | Liu | 108/132 |
| 2007/0157390 | A1 * | 7/2007 | Molinaro | 5/626 |

* cited by examiner

*Primary Examiner* — William Kelleher
(74) *Attorney, Agent, or Firm* — Gifford, Krass, Sprinkle, Anderson & Citkowski, P.C.

(57) ABSTRACT

A combination patient support table and stretcher assembly having a patient support surface including at least first and second planar sections convertible between first end-to-end secured and second collapsible arrangements. A plurality of legs extend from corner locations associated with the planar support sections, the legs are convertible at least between first downwardly supporting and second outwardly pivoting positions. The assembly operates in a selected configuration as a ground supported and elevated table, and which can further be reconfiguring through actuation of the legs to reconfigure as a patient transportable stretcher.

4 Claims, 4 Drawing Sheets

COMBINATION MEDICAL SUPPORT TABLE AND PORTABLE CONVERTIBLE STRETCHER UNIT

FIELD OF THE INVENTION

The present invention relates generally to convertible stretcher assemblies. More specifically, the present invention teaches a combination table and convertible stretcher assembly, and such as including a multi-section and foldable support surface, in addition to extending legs which can pivot between table supporting (vertical) and stretcher extending (horizontal) positions, and in addition to being retractable within seating locations associated with the sectioned support surface for portability of storage or transport.

BACKGROUND OF THE INVENTION

Various types of convertible cot and patient transport assemblies are known in the prior art. A first example of such a device is disclosed in the multiple purpose ambulance cot with removable stretcher top set forth in U.S. Pat. No. 4,037,871, to Bourgraf. The ambulance cot includes a base structure which serves as a carrier for a removable stretcher forming a top for the carrier.

Loescher, U.S. Pat. No. 5,345,881, teaches a folding table mechanism employing hollow rail members which support the mechanism therebetween. A pair of legs are mounted to the ends of a stretcher member to form a folding unit, and which is both translated and rotationally connected to the rail members by an over center cam mechanism operated by a lock bar capable of exerting locking force in both the unfolded and folded positions of the table legs.

Wicks, U.S. Pat. No. 3,167,789, teaches a patient supporting and carrying means for operating as a stretcher table and hospital bed and which includes multiple hinged and assembleable sections. Bono, U.S. Pat. No. 5,201,536, discloses a multi-purpose combination carrier cart/table.

SUMMARY OF THE PRESENT INVENTION

A combination patient support table and stretcher assembly having a patient support surface including at least first and second planar sections convertible between first end-to-end secured and second collapsible arrangements. A plurality of legs extend from corner locations associated with the planar support sections, the legs are convertible at least between first downwardly supporting and second outwardly pivoting positions. The assembly operates in a selected configuration as a ground supported and elevated table, and which can fu-tier be reconfiguring through actuation of the legs to reconfigure as a patient transportable stretcher.

Additional features include a lunged connection established between the at least first and second planar sections. A central planar section separates the first and second edge extending sections. First and second edge extending sections can also be hingedly secured to opposite upper and underside surfaces associated with a central section, such that the edge extending sections may disengaged from the end-secured arrangement and prior to rotating to the collapsed and stowable arrangement.

In a further desired variant, a selected planar section is linearly displaceable and insertable within a side apertured and interiorly hollowed additional planar section, a central planar section separating first and second edge extending sections. The first and second edge extending sections are each nearly displaceable in a storable configuration relative to first and second interiorly hollowed regions defined within an elongated central section. Catch portions retain the edge extending sections in either of inwardly displaced stowed or outwardly extending use positions relative to the central section.

Additional features include pivotally and releasably engageable bracket supports secured against underside locations of a central planar section and, upon pre-rotating the legs to their downwardly extending and supporting positions, the brackets are converted about locations associated with the central section to secured to locations of the downwardly extending legs in order to provide desired reinforcing support to the assembly. Wheels extending from bottom end locations of the legs provide the configured table assembly wide the ability to be more easily transported upon a ground location, while also incorporating such as locking means or the like for selectively immobilizing the table. Inwardly extending recess channels are also defined within exposed outermost edges of the planar sections, the outwardly pivoted legs adapted to be slidingly inserted within the channels.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENTS

Figure 1:
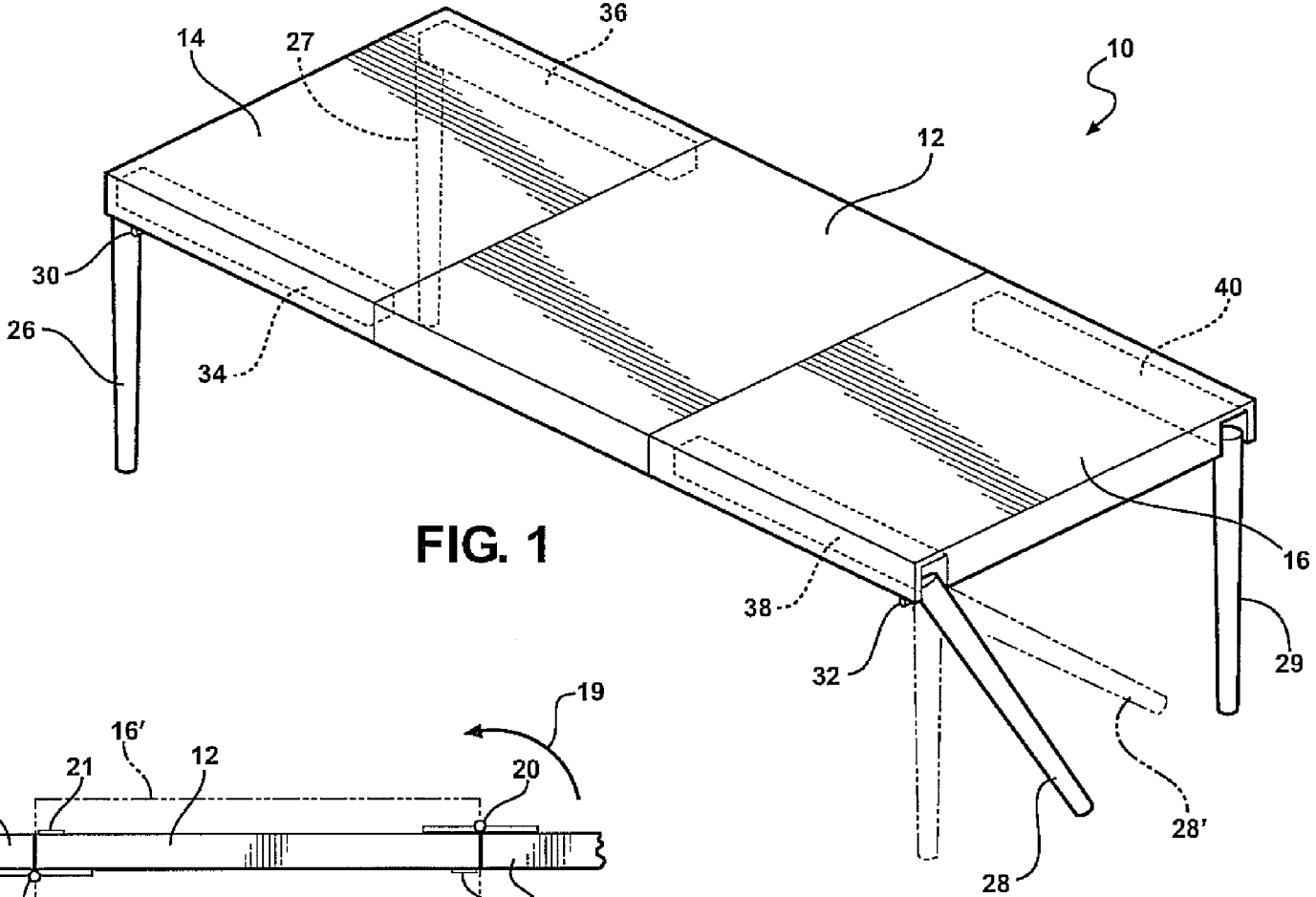
FIG. 1 is a perspective view the convertible support table and stretcher according to a first preferred configuration, and illustrating a plurality of corner located legs convertible between table, stretcher and retracted configurations.

Referring now to FIG. 1, a perspective view is shown at 10 of a combination convertible support table and stretcher according to a first preferred configuration. As will be further described, the present invention teaches a combination table and stretcher assembly which is capable of being utilized by such as an EMS or ambulance unit, and which can operate in multiple configurations to act both as a stretcher and a hospital (triage) type device. A furthering advantage of such an assembly is by dispensing with the requirement of having to move a patient from a stretcher to a table, thereby avoiding the attendant possibility of further injury and/or discomfort, such as in the instances of spinal injuries, burns or the like.

Referring again to FIG. 1, a multi-section and foldable support surface is referenced by center section 12 and left and right opposite edge connected and mutually convertible sections 14 and 16. Each of the sections 12, 14 and 16 exhibit a generally four sided rectangular shape with a desired thickness and are constructed of a durable and high strength material, including a lightweight metal or a durable (composite) plastic. It is also envisioned that the table sections can include other composite and recyclable materials, incorporating plastics, with or without the addition of other combined and/or entrained particles, and in order to provide the multi-section construction with a maximum degree of durability.

Figure 1A:
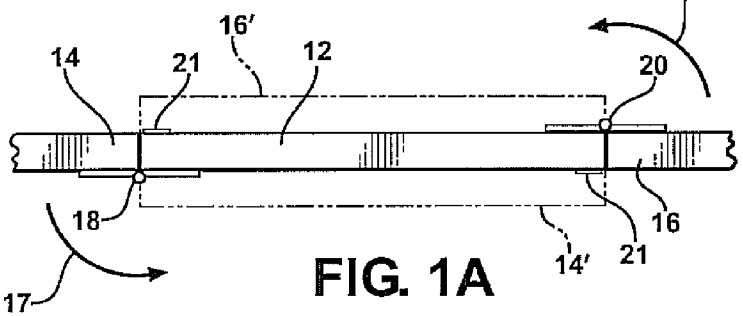
FIG. 1A is an illustration of a first folding arrangement of the edge extending sections relative to a central section and in the directions referenced by first and second arrows.

The individual sections 12, 14 and 16 each further exhibit a planar upper surface and can be interconnected in a first configuration by hinged portions (see inset at 18 and 20 in FIG. 1A) and which allow the left and right opposite edge connected and mutually convertible sections 14 and 16 to pivot in sandwiching arrangement relative to the center section 12 (see in phantom at 14' and 16') and the manner evidenced by rotational arrows 17 and 19. In this fashion, the sections 14 and 16 can be folded against opposite surfaces of the central section 12, and thereby convert the patient support surface to a portable/stowable configuration. It is further understood that latches or other suitably configured catch portions (see for example as representatively shown at 21 for restraining each of the end sections 14' and 16' in their folded sandwich arrangement) can be provided for retaining each of the sections 12, 14 and 16 in either the unfolded/use or folded/stowed positions.

Figure 1B:
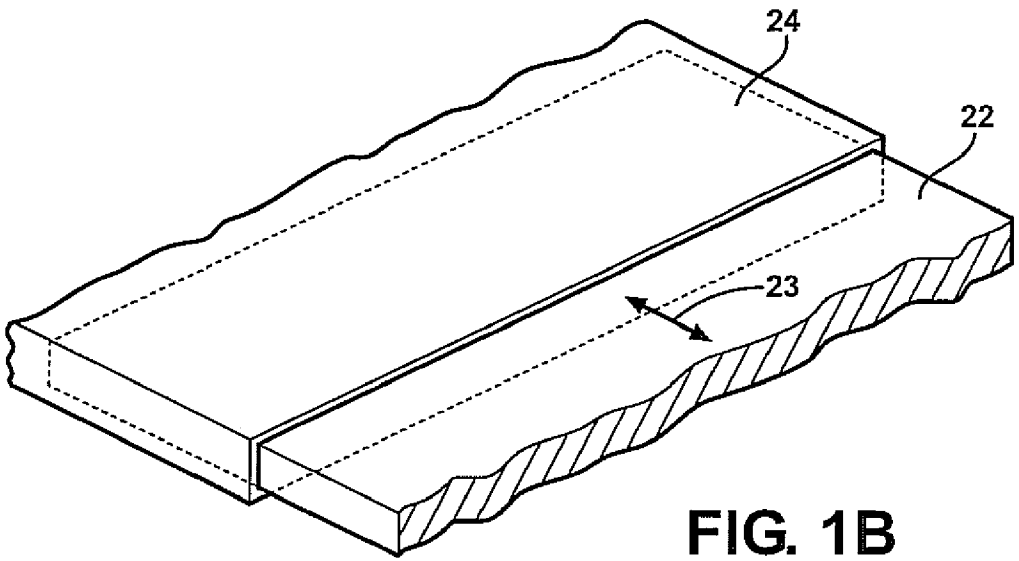
FIG. 1B is a further inset portion illustrating a selected edge extending section in a linearly displaceable and interiorly telescoping/storable configuration relative to a lengthened, side apertured and interiorly hollowed central section according to a further desired variant.

FIG. 1B illustrates a further inset portion of an alternative configuration of support table and which illustrates a selected edge extending section 22 in a linearly displaceable and telescoping storable configuration (see arrow 23) relative to a lengthened, side apertured and interiorly hollowed central section 24 (i.e. the central section must be lengthened to the degree necessary to define linear extending central pockets of sufficient dimension to seat and retain the secondary pullout side panels). Although not shown, catch portions or the like can again be incorporated into the table design, and in order to retain the edge extending sections in either the inwardly displaced stowed or outwardly extending use position. It is also understood that the central section 24 in FIG. 1B can be dimensioned to be sufficiently elongated to store both opposite edge extending sections in mutually retracted fashion.

Referring again to FIG. 1, a plurality of legs are represented by legs 26 and 28, with additional legs 27 (in phantom) and 29 also being illustrated in FIG. 1. The legs each exhibit a specified and elongate configuration and are connected by hinge or clip portions, see at 30 and 32 in FIG. 1, and which facilitate the rotational adjustment of the legs 26-29 between the downwardly extending and table supporting position (as best shown by legs 26 and 29) and a pivoting arrangement between vertical supporting and horizontal (stretcher) extending or retracted positions, see further as best shown by pivoting direction of leg 28 toward horizontal extending position 28'.

A plurality of interior recessed cavities, see as shown at 34, 36, 38 and 40, are defined in an inwardly and linearly extending fashion which are accessible from opposite end surfaces of the edge extending sections 14 and 16, and positioned proximate each corner of the selected edge extending sections 14 and 16. In one preferred embodiment, the associated legs are dimensioned such that they can be lengthwise inserted into the cavities, upon being first rotated to the horizontal (stretcher) configuration referenced again at 28' for leg 28.

The use of appropriate retaining and disengaging structure is envisioned, and such as enabling the legs to be releasably locked in a desired downward (26, 29) or in a generally linearly outward fashion (see as again referenced by selected leg positioned at 28'), this combined with the ability to permit the legs to be further slidably inserted into the recess channels when desired to convert the assembly to a stored configuration. In this fashion, the legs in combination with the associated bracket/clip structure can be locked in either a table top or stretcher configuration. Additional variants also contemplate substituting the inwardly recessed channels shown in favor of underside configured and surface accessible recesses (not shown) for releasably engaging the legs against the underside of such as the center section 12.

Figure 2:
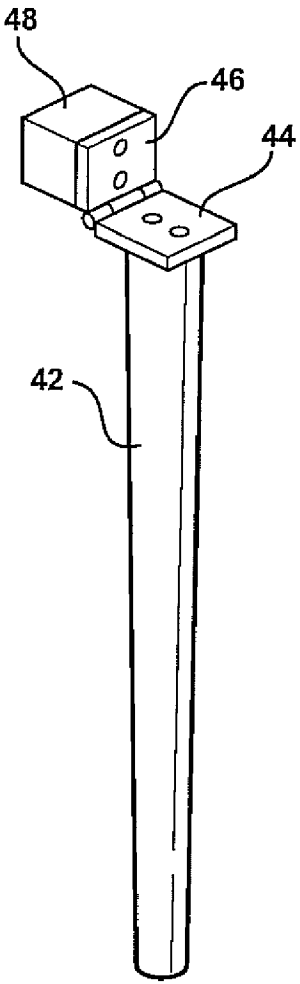
FIG. 2 is an enlarged sectional view of a selected and hinge supported leg, such as associated with the embodiment of FIG. 1.

Referring further to FIG. 2, an enlarged sectional view is shown of a selected and hinge supported leg 42, such as which can be envisioned as associated with the embodiment of FIG. 1. A two part hinge assembly 44 & 46 is provided, the portion 44 defining an end face of the pivotally associated and downwardly extending leg, with the further hinged end face 46 associated with an upper fixed portion 48 to facilitate pivoting of the leg 42 relative to the fixed upper portion 48 and such as which can be mounted to each corner location of the convertible stretcher/table.

Figure 3:
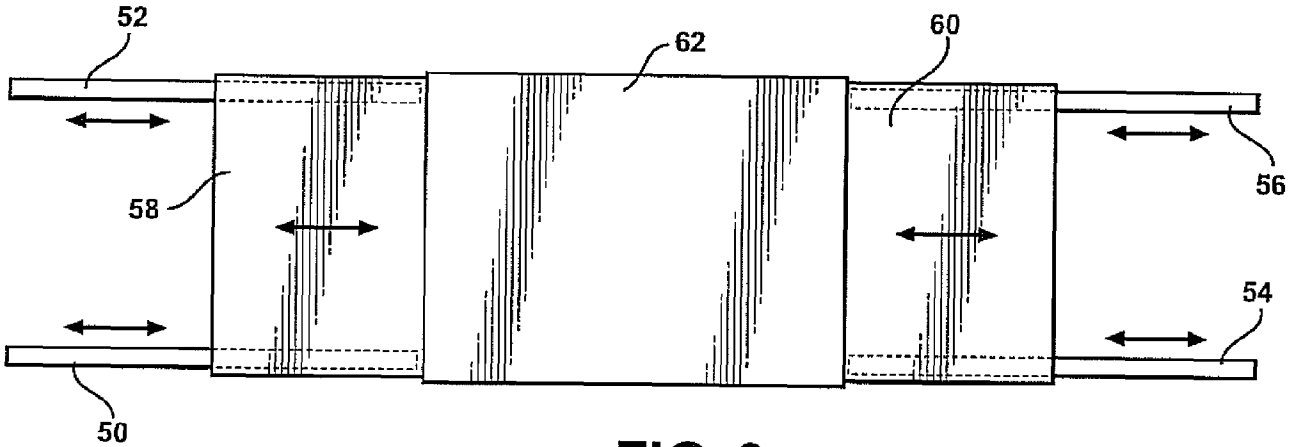
FIG. 3 is a top plan view of a stretcher configuration similar to the arrangement discussed in FIG. 1B and which is associated with another configuration of the present invention and better illustrating the inwardly retractable nature of the hingedly connected support legs and associated side sections relative to a center section.

Referring to FIG. 3, a top plan view is shown of a stretcher configuration associated with another configuration of the present inventions, and better illustrating the inwardly retractable nature of each of four hingedly connected support legs 50, 52, 54 and 56 relative to end extending sections 58 and 60 arrayed on opposite ends of a central section 62. Similar to FIG. 1, the legs 50-56 are designed to inwardly displace into recess cavities (see as shown in phantom) which are defined at the four corners of the platform surface as again depicted by the end extending sections 58 and 60. As described previously, an appropriate lock or catch structure can be incorporated into each pivoting location (see as shown at 30 and 32) The legs are also disclosed as being capable of folding relative to the end sections 58 and 60 and can thereby collapse to either of the configurations of FIGS. 4 and 5.

Figure 4:
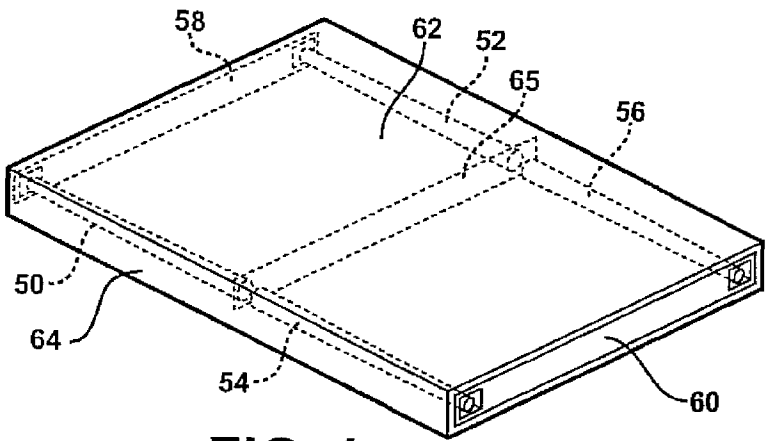
FIG. 4 is a further illustration of the convertible table/stretcher of FIG. 3 in a folded or telescopically collapsed configuration.

FIG. 4 is a further illustration of the telescoping convertible table/stretcher of FIG. 3 in an inwardly recessed and collapsed configuration, and by which the end sections 58 and 60 are recess installed within the central section 62. A central and widthwise extending divider, see as shown at phantom at 65, is embedded within the central section and which can provide an inserting end-stop for each of the telescopically displaceable end sections 58 and 60.

Figure 5:
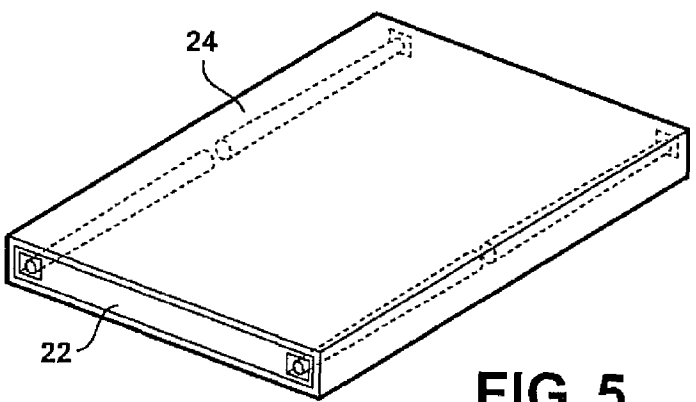
FIG. 5 is a rotated perspective view of a table, such as not illustrating handles, according to the present inventions.

FIG. 5 is a rotated perspective view of the table shown in the sub-variant of FIG. 3, such as not illustrating handles or other suitable grasping structure. In particular, the slidably collapsed or folded arrangement established by the combination article in the stowed position can include handles, straps or the like for increased portability and handle-ability. Similar to the arrangement of FIG. 4, the telescopically collapsible variant of FIG. 5 relies upon a cored or interiorly hollowed central section 24 which exhibits sufficient strength and resilience in the extended operating position and when not housing the retractable/pull out end sections.

Figure 6:
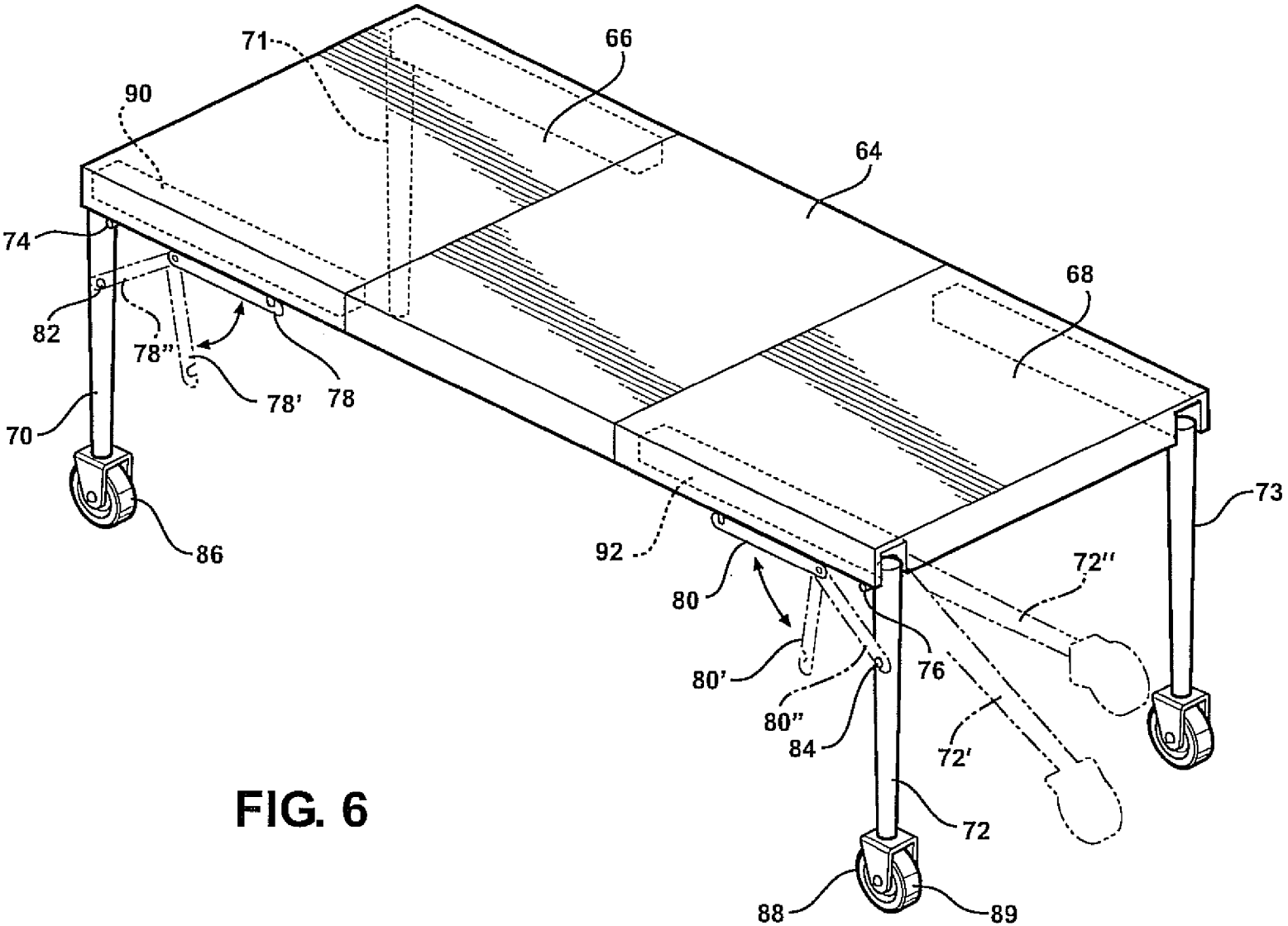
FIG. 6 is an illustration similar to FIG. 1 and showing a further variation of wheel supported and bracket reinforcing table according to a further preferred embodiment of the present invention.

Finally, and referring to FIG. 6, an illustration similar to FIG. 1 shows a further variation of a wheel supported and bracket reinforcing table according to a further preferred embodiment of the present invention and which includes a central support section 64, with first and second opposite and edge extending sections 66 and 68. The sections are again produced of a suitable plastic or composite material construction and can be either hingedly (as shown) or slidably inserted relative to the central section, such as according to any of the embodiments previously described.

A plurality of legs, illustrated by front legs 70 and 72 and rear legs 71 and 73, are again convert-ably mounted to associated corner defined locations of the outer and edge extending sections 66 and 6S. The legs can again be constructed of materials similar to those associated with the planar support defining central section 64 and end engaged sections 66 and 68 and can be hingedly or otherwise pivotally secured in selectively releasable fashion in either of downward extending and horizontally disposed fashions.

Clips 74 and 76 are illustrated and which can be utilized to selectively engage the legs 70-73 in their downwardly pivoted and table supporting locations and, such as in combination with a suitable hinged attachment (not shown but previously representatively illustrated in FIG. 2) associated with the legs and for converting between downward extending table defining positions (as shown in solid by legs 70, 72 and 73), and upwardly pivoted (see in phantom by succeeding positions 72' and 72" for leg 72) positions for converting to stretcher bearing assembly. Although not shown, it is understood that other suitable and/or additional clip or retaining type structure (such as provided by the clips 74 and 76 alone or in combination with other hardware) can be employed with the legs in their outward horizontally disposed position, and to thereby releasably fix them in place for use in a stretcher bearing configuration.

Additional and pivotally engageable bracket supports, see at 78 and 80, can be secured in initial stowed positions against underside locations of the edge extending sections 66 and 68, and such as through the provision of resistive snap fit or other restraining fasteners. Upon pre-rotating the legs to their downwardly extending and supporting positions, the brackets 78 and 80 are converted (such as pivotally or hingedly) about first and second opposite and edge extending sections 66 and 68 undersides, and through intermediate 78' and 80' and final downward 78" and 80" extending positions, at which point end clip portions 82 and 84 of the brackets are secured to intermediate locations (e.g. clip or bracket defined) of the selected illustrated downwardly extending legs 70 and 72 and in order to provide desired reinforcing support to the assembly. The clip portions 82 and 84 can include slot and tab or other defined structure for quickly securing to the illustrated locations of the legs 70 and 72, it also being understood that a suitable reconfigured scissor assembly (not shown) can be provided for each leg to edge extending section connection and by which the leg can be pivotally associated therewith for converting between downwardly extending table top support and outwardly/horizontally extending stretcher support configurations, such as without first requiring such a reconfigured clip or catch assembly from being disengaged from the leg.

Wheels, such as castor or trolley supporting wheels, are referenced (at 86 and 88 for legs 70 and 72). The wheels 86 and 88 provide the converted table assembly with the ability to be more easily transported upon a ground location, while also incorporating such as locking means or the like (see at 89 for wheel 88) for selectively immobilizing the table. The design of the wheels is further such that they do not interfere with the use of the legs in an outward and horizontally extending stretcher configuration, nor do they prevent the legs from being inwardly displaced relative to edge defined and inwardly extending recess channels, see further at 90 and 92 for associated legs 70 and 72. In this fashion, the wheels 86 and 88 can either be totally recessed within outermost locations of the inward channels 90 and 92 or, alternatively, project a limited and non-hindering distance from outer side edge surfaces of the outer extending portions 66 and 68. It is also envisioned that the legs 70 and 72, upon being recess fitted within the channels 90 and 92, can be prevented from inadvertently displacing outward, such as through the use of catches, tabs, resistant press fit portions, or the like (not shown).

Having described my invention, other and additional preferred embodiments will become apparent to those skilled in the art to which it pertains, and without deviating from the scope of the appended claims. Along these lines, the three-section planar support arrangement illustrated in the figures and also include bi-section and central folding planar support, as well as multiple support defining sections in excess of the three shown, along with the provision of any necessary bracketry required for providing reinforcing support to the table sections and legs when converted to or between their downwardly extending and supporting, upwardly rotated and horizontally extending, and inwardly recess inserted or folding configurations.

I claim:

1. A combination patient support table and stretcher assembly, comprising:

a patient support surface including a planar and interiorly open central section, first and second planar end extending sections being telescopically displaceable relative to first and second open ends of said central section and in order to be convertible between first extended use and second collapsed non-use arrangements; and a plurality of legs pivotally connected to and extending from corner locations associated with said end extending sections by a two part hinge assembly, an upper hinge supporting portion associated with each leg in turn communicable with a recessed cavity defined in inwardly and linearly extending fashion within an edge extending interior of said end sections such that, in said extended use arrangement with said hinge supporting portion in an outward most extended position relative to said associated recessed cavity, said legs being convertible between a first downwardly supporting position in which said assembly functions as a table top surface and second outwardly pivoting positions in which said pairs of said legs extend in opposite and parallel fashion relative to said end extending sections to further function as a patient transportable stretcher;

said legs displacing inwardly within said recessed cavities and said opposite end extending sections in turn displacing within said central section in order to achieve said collapsed non-use arrangement.

2. The combination patient support table and stretcher assembly as described in claim 1, further comprising catch portions retaining said edge end extending sections in either of inwardly displaced stowed or outwardly extending use positions relative to said central section.

3. The combination patient support table and stretcher assembly as described in claim 1, further comprising pivotally and releasably engageable bracket supports secured against underside locations of a central planar section wherein upon rotating said legs to their downwardly extending and supporting positions, said brackets being converted about locations associated with said central section to secure to locations of said downwardly extending legs, to provide reinforcing support to the assembly.

4. The combination patient support table and stretcher assembly as described in claim 1, further comprising wheels extending from bottom end locations of said legs in order to provide said configured table assembly with the ability to be more easily transported upon a ground location, further comprising locking means for selectively immobilizing the table.

* * * * *

UNITED STATES PATENT AND TRADEMARK OFFICE

CERTIFICATE OF CORRECTION

PATENT NO. : 8,209,802 B2
APPLICATION NO. : 12/420587
DATED : July 3, 2012
INVENTOR(S) : Miguel A. Linares It is certified that error appears in the above-identified patent and that said Letters Patent is hereby corrected as shown below:

In the Specifications:

At Column 1, Line Number 50, delete “fu-tier”, insert --further--.

At Column 1, Line Number 53, delete “lunged”, insert --hinged--.

At Column 2, Line Number 14, delete “wide”, insert --with--.

At Column 5, Line Number 9, delete “6S”, insert --68--.

Signed and Sealed this
Twenty-fifth Day of December, 2012

David J. Kappos

David J. Kappos
*Director of the United States Patent and Trademark Office*